United States Patent [19]

Hudspeth et al.

[11] Patent Number: 4,652,841

[45] Date of Patent: Mar. 24, 1987

[54] SQUARAX SWITCH

[75] Inventors: Thomas Hudspeth, Malibu; Barry S. Ross, Manhattan Beach, both of Calif.

[73] Assignee: Hughes Aircraft Company, Los Angeles, Calif.

[21] Appl. No.: 607,326

[22] Filed: May 4, 1984

[51] Int. Cl.[4] ..... H01P 1/12

[52] U.S. Cl. ..... 333/107; 200/153 S; 333/244; 333/260

[58] Field of Search ..... 200/153 S; 333/106, 333/107, 260–262, 244

[56] References Cited

U.S. PATENT DOCUMENTS

| | | | |
|---|---|---|---|
| 2,426,186 | 8/1947 | Dow | 333/262 X |
| 2,555,154 | 5/1951 | Raymond | 333/107 |
| 2,753,531 | 7/1956 | Butler | 333/261 |
| 2,759,153 | 8/1956 | Charles | 333/107 |
| 2,796,589 | 6/1957 | Adams | 333/244 |
| 2,816,198 | 12/1957 | Cherry | 200/153 S |
| 3,132,311 | 5/1964 | Wozniak | 333/107 |
| 3,201,721 | 8/1965 | Voelcker | 333/260 X |
| 3,369,096 | 2/1968 | Gattaz | 200/153 S |
| 4,019,162 | 4/1977 | Banning | 333/244 |
| 4,039,974 | 8/1977 | Clark et al. | 333/107 |

*Primary Examiner*—Paul Gensler

*Attorney, Agent, or Firm*—S. M. Mitchell; M. J. Meltzer; A. W. Karambelas

[57] ABSTRACT

A switch (11) for a square coaxial network includes a lower housing (13), a rotor assembly (21), alternative transmission lines (19), and an upper housing (15) with a main transmission line (17). The rotor assembly includes a rotor (23) for selectively coupling the main transmission line to a selected alternative transmission line. The rotor is coadapted with each transmission line for resonant coupling therewith. A conductive shield (29) rotates with the rotor and isolates it from the unselected alternative transmission lines. A low-friction dielectric guide (25) helps provide proper spacing and coupling of the rotor and the square center conductor (35) of the selected alternative transmission line. A low-friction dielectric bushing (27) serves a similar function for the rotor and the center conductor of the main transmission line.

19 Claims, 9 Drawing Figures

Fig. 7.
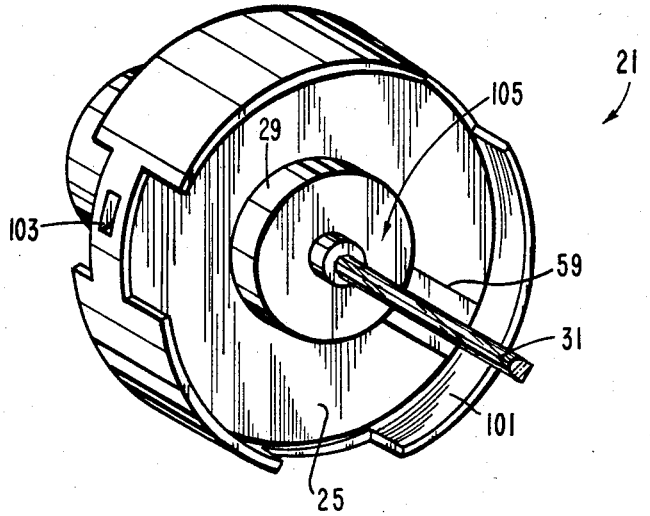
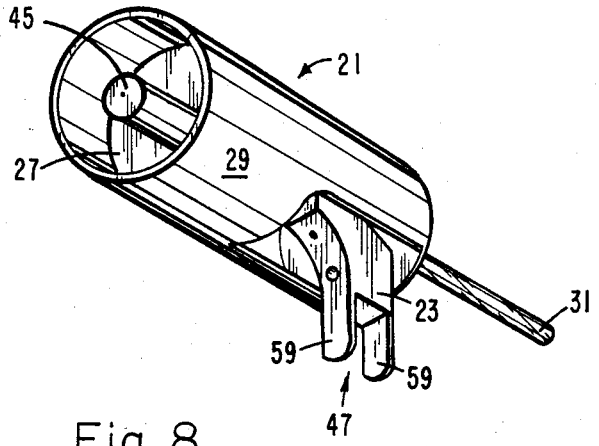
Fig. 8.
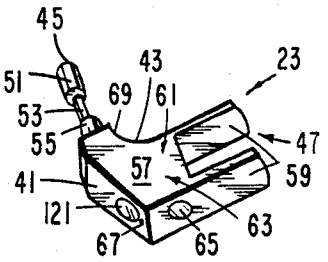
Fig. 9.

SQUARAX SWITCH

BACKGROUND OF THE INVENTION

The present invention relates to microwave switches, and more particularly to such switches for square coaxial networks.

Square coaxial networks have provided effective transmission and processing of microwave energy. Less bulky than waveguide and less lossy than microwave integrated circuits, square coaxial networks have become increasingly utilized in satellite communications. This increased utilization has generated a need for improved switches for such networks.

For maximum efficiency, microwave beam shape and direction should be tailored to the target continent or area and its position relative to the communications satellite. The determination of beam shape and direction may be provided by alternative subnetworks feeding a common antenna.

Heretofore, relays have been used in selecting the appropriate network. However, the relays have required the use of adaptors and connectors which are bulky and decrease reliability. Furthermore, depending on design, various other problems have arisen. Contact points wear and decrease reliability. Isolation of unused components is often insufficient. Transmission and reflection losses are unacceptably high.

What is needed is an improved square coaxial switch for satellite communications and other applications. Such a switch should be efficient, reliable, durable, compact and lightweight.

SUMMARY OF THE INVENTION

In accordance with the present invention, a switch for a microwave square coaxial network selectively connects a main port to one of several alternative ports. The switch includes a main transmission line electromagnetically connected to the main port, and alternative transmission lines, each electromagnetically connected to a respective alternative port. A rotor serves to connect the main transmission line to a selected alternative transmission line.

The rotor is rotatable about an axis. An axial end of the rotor is coadapted with the main transmission line so as to maintain resonant coupling at and about a center frequency in any rotational position of said rotor about said axis of rotation. Rotation of the rotor about the axis permits positioning of an off-axis or radial rotor end adjacent a selected alternative transmission line. The alternative transmission lines and the radial end of the rotor are coadapted for resonant coupling about the center frequency. The effective electrical length of the rotor is an odd-integral number of quarter-wavelengths.

The resonant couplings alleviate the need for mechanical contacts which can adversely affect the durability and reliability of a switch. Preferably, a shield for electrically isolating the rotor from unused ports is provided. The shield may be mechanically coupled to said rotor so as to rotate therewith.

BRIEF DESCRIPTION OF THE DRAWINGS

FIG. 7 is a perspective view of a rotor assembly and guide of the switch of FIG. 1.

FIG. 8 is a perspective view of a rotor assembly of the switch of FIG. 1.

FIG. 9 is a perspective view of a rotor in accordance with the present invention.

DESCRIPTION OF THE PREFERRED EMBODIMENTS

Figure 1:
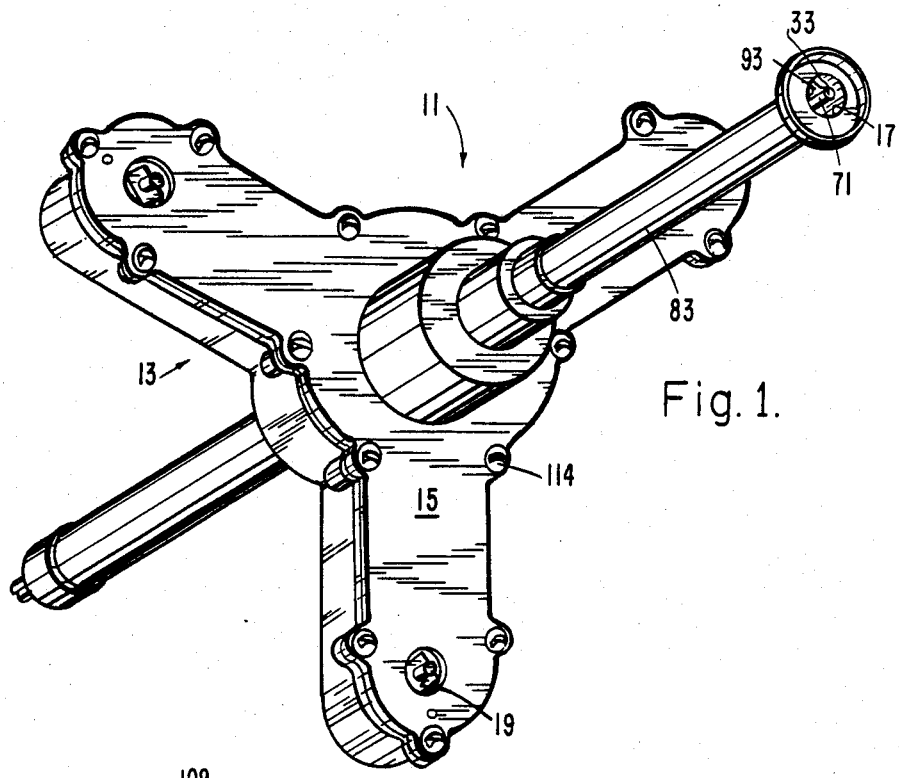
FIG. 1 is a perspective view of a switch in accordance with the present invention.
Figure 2:
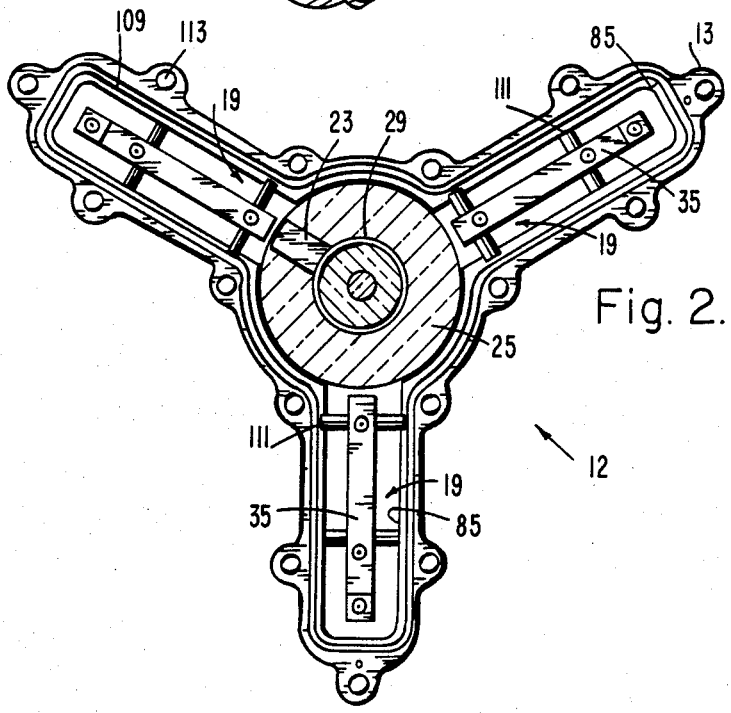
FIG. 2 is a plan view of a bottom subassembly of the switch of FIG. 1.
Figure 3:
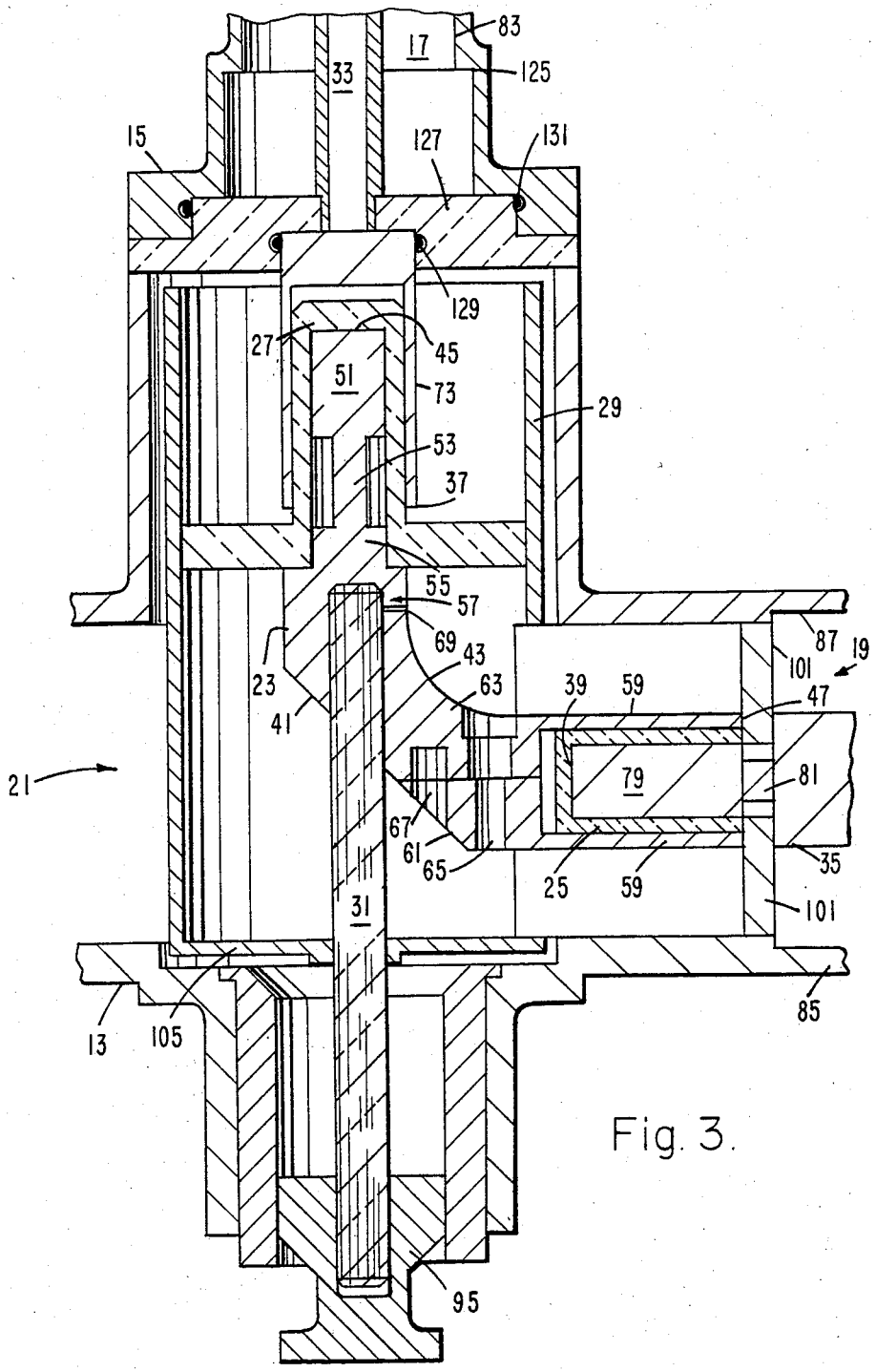
FIG. 3 is a sectional view of a rotor assembly and adjacent components of the switch of FIG. 1.
Figure 4:
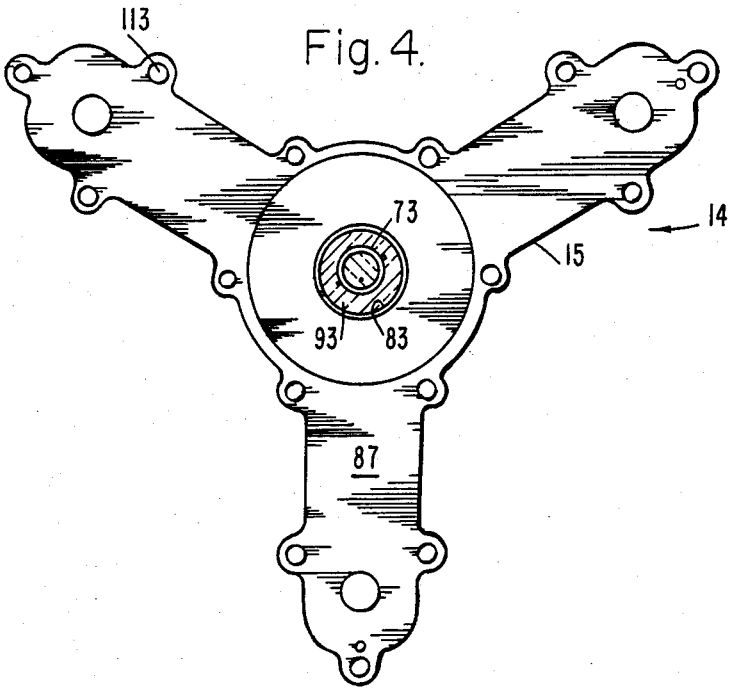
FIG. 4 is a bottom plan view of a top assembly of the switch of FIG. 1.

A switch 11 for a square coaxial microwave network includes a lower assembly 12, and an upper assembly 14, as indicated principally in FIGS. 1, 2 and 4. The lower illustrated in FIG. 2, includes a lower housing 13, a rotor assembly 21, and transmission lines 19. The upper assembly 14, illustrated in FIG. 4, includes an upper housing 15 coupled to a main transmission line 17 (see FIGS. 1 and 3). The switch 11 shown is a 3-way switch, and accordingly has three alternative transmission lines 19. The center operating frequency of the illustrated embodiment is, nominally, 4.0 GHz. Scaling the illustrated embodiment by a factor of 0.6338 provides a switch for a nominal 6.0 GHz network.

Referring to FIG. 3, the transmission path including the inner end 39 of a center conductor 35 of an alternative transmission line 19, the rotor, and the proximal end 37 of a cup 73 coupled to the center conductor 33 of the main transmission line 17 effectively forms a pair of series resonant circuits with spacing of one-quarter wavelength at the center operating frequency. Alternatively, other odd-number quarter wavelengths could be used. The resonators behave like series resonant circuits in the frequency range of operation with reactive elements of about 25 ohms at the center frequency. The combination forms a maximally flat bandpass filter with a bandwidth much greater than the intended operating bandwidth, and therefore has low mismatch loss.

The rotor 23, illustrated in FIG. 9, is an angled conductor. The angle has a bevel 41 at the outside and a curve 43 to its inside so as to minimize loss due to reflections. The rotor 23 includes an axial end 45 for coupling to the main transmission line 17, and an off-axis or radial end 47 for selectively coupling to one of the alternative transmission lines 19. Proceeding from the axial end 45 to the radial end 47, the rotor 23 comprises: a cylindrical portion or "head" 51—the axis of which is the axis of rotation of the rotor 23, a thinner cylindrical portion or "neck" 53, a third cylindrical portion 55, a "body" 57 including two portions of square cross section joined by the beveled angle section, and two flat "legs" 59 disposed parallel with one another and perpendicular to the axis of rotation. The wider head plus narrower neck configuration provides a resonator considerably less than a quarter wavelength long, providing a smaller axial extent for the overall switch.

For ease of assembly with a guide 25 and a shield 29, shown in FIG. 7, the rotor 23 is formed from two parts 61 and 63, joined together with a bolt fitting in a hole 65. The bolt cooperates with a pin in a hole 67 to maintain the rigidity of the rotor 23. A second pin in a hole 69 toward the axial end 45 of the rotor 23 helps maintain a snug fit of the rotor 23 over a drive shaft 31.

The main transmission line includes a center conductor 33, shown in FIG. 3, with a means for connecting to a square coaxial subnetwork at a port at distal end 71 (FIG. 1) and a cup 73 coadapted with the axial end 45 of the rotor 23 for resonant coupling. More particularly, the rotor head 51 is within the cup 73 upon assembly of the switch 11, as shown in FIG. 3. The circular cross sections of the head 51, which rotates with the rotor 23, and of the cup 73, which does not rotate with the rotor 23, ensure constant coupling independent of relative orientation. A bushing 27 fitted snugly on the rotor head 51 helps to maintain precise spacing of the cup 73 and rotor 23 throughout rotation. Generally circular dielectric spacers 93 are used to precisely position the main conductor rod within the upper housing.

Figure 5:
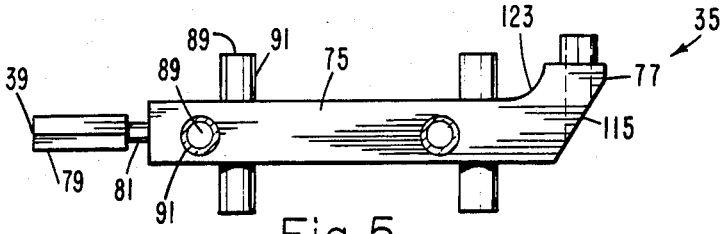
FIG. 5 is an elevational view of a square center conductor of the switch of FIG. 1.
Figure 6:
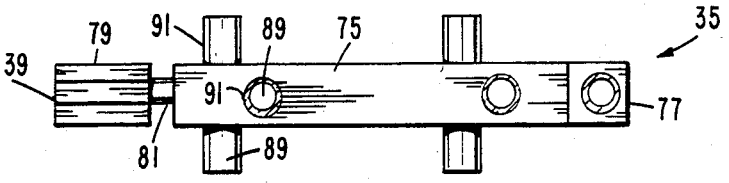
FIG. 6 is a plan view of a square center conductor of the switch of FIG. 1.

Each alternative transmission line 19 includes a center square conductor 35, illustrated in FIGS. 5 and 6, with an intermediate extent 75, an outer end 77 and an inner end 39. The intermediate extent 75 of each center square conductor has a square cross section. Each outer end 77 is adapted for connection to a square coaxial subnetwork. As best seen in FIG. 5, each outer end 77 is angled to provide for connection orthogonal to the radially extending intermediate extent 75. The inner end 39 has a head 79 joined to the intermediate extent 75 by a thinner cylindrical shank 81. As noted above, the head-shank configuration allows a shorter resonator; in the present case, this results in a smaller radial dimension for the overall switch 11. The head 79 is shaped to fit between the legs 59 of the rotor 23.

The upper and lower housings 13 and 15, when assembled, constitute a switch housing which provides the outer conductors for the main and alternative transmission lines 17 and 19. In other words, the cylindrical portion 83 (FIGS. 1 and 3) of the upper housing 15 serves as an outer conductor for the main transmission line 17. The walls 85 of the lower housing 13 cooperate with planar portions 87 of the upper housing to form an outer conductor for the square alternative transmission lines 19. In the illustrated embodiment, the alternative transmission lines 19 and the main transmission line 17 have impedances of 50 ohms.

Dielectric pegs 89 serve to space precisely the square cener conductors 35 within the housings. The pegs 89 extend through and beyond holes in the conductors. Dielectric tubes 91 cover the portions of the pegs 89 extending beyond the conductor 35, as indicated in FIGS. 5 and 6. The tubes 91 reinforce and help maintain the position of the pegs 89. For each alternative transmission line 19, one pair of pegs 89 extends parallel to the rotor axis, and another extends perpendicular to the rotor axis. The individual pegs 89 of each pair are preferably spaced one-quarter wavelength apart, at center frequency.

The shaft 31 with a D-shaped cross section extends from the rotor 23 along its rotational axis, as shown in FIGS. 3, 7 and 8. The shaft 31 is supported by a sleeve bearing 95 in the lower housing 13. The shaft 31 extends into the lower housing 13 where it is linked to a drive element (not shown), itself extending through the lower housing 13. The switch 11 is responsive to external manipulation via this drive element which is accessible from below the lower housing. A metal bellows (not shown) between the drive element and the shaft 31 increases tolerance for misalignment of the shaft 31 and drive element. The shaft 31 may be of rigid insulating material, such as sapphire.

The rotor guide 25 is generally disc-shaped, as shown in FIG. 7. Flanges 101 provide precise vertical spacing of the guide 25 within the housings 13 and 15. Three slots 103 are provided for receiving the heads 79 of the three square center conductors 35. This arrangement helps to align precisely the square center conductors 35 and to define the spacing between the legs 59 of the rotor 23 and an adjacent head 79 of an alternative transmission line 19. The guide is preferably fabricated of a low friction, dielectric material, such as polytetrafluoroethylene.

The guide 25 serves as a thrust bearing for the rotor 23. In addition it increases the capacitance of the resonator head 79 of each square conductor; this allows the head 79 to be shorter and the overall switch 11 to be more compact.

The shield 29 is attached to the rotor 23 so as to rotate coaxially therewith, as shown in FIGS. 3, 7 and 8. The illustrated shield 29 is generally cylindrical. It includes a base 105 and is open at the top to receive the cup 73 of the main transmission line 17. A cutout on the cylinder near the base allows the legs 59 of the rotor 23 to protrude outside the shield 29. This configuration of the shield 29 serves to prevent undesired coupling, particularly between the rotor 23 and unselected alternative transmission lines. The shield 29 also keeps the transmission impedance approximately 50 ohms about the 90° bend from radial to axial. The shield 29 is positioned close to housing walls so that the effect on the transmissions is essentially the same as if the shield 29 electrically contacted the walls. The shield 29 is formed of conductive material with a low-friction external coating, e.g. aluminum with a coating of polytetrafluoroethylene.

The low-friction bushing 27 is provided to mutually space the shield 29, the rotor head 51 and the cup 73 of the main center conductor. The bushing 27 also serves as a sleeve type bearing for the cup 73 so as to allow the rotor assembly 21 to rotate relative to the cup 73. The bushing 27 also supports the capacitance shield 29 so it rotates with the center rotor 23. The bushing 27 is formed of a low-friction dielectric such as polytetrafluoroethylene.

The insulating support 127, shown in FIG. 3, fixes the axial location of the main transmission line center conductor 33, onto which it is pressed. It receives the cup 73 which snaps into a groove 129 in the support 127. The support 127 is also pressed into the upper housing 15 and is captured when combined with the rest of the upper assembly 14. The support 127 also snaps into the groove 131. Small rings machined into the support 127 provide the snapping action.

Impedance measurements in the main transmission line 17 were made. At the end 37, the measurement was 72 ohms. A 60 ohm quarter wavelength transmission line is included to match from 72 ohms to 50 ohms, the characteristic impedance of the remainder of the main transmission line 17. Accordingly, the outer diameter of the cup 73, the outer diameter of the support 127, and an impedance matching section 125 of the upper housing 15 are proportioned to form sections of 60 ohm transmission lines of a total electrical length of a quarter wave at the center frequency of operation.

Provisions for tuning the switch 11 may be made by inserting conductive elements through tuning holes (not shown) in the walls of the lower housing 13 adjacent the alternative transmission lines 19. The lower housing 13 includes a shallow perimeter groove 109 for precise placement of an elastic seal (not shown) between the upper and lower housings 13 and 15. Corresponding to each alternative transmission line 19 are pairs of transverse grooves 111 for receiving opposing pegs 89 so that precise radial placement of the corresponding alternative transmission line 19 can be maintained. The housings 13 and 15 contain alignable assembly holes 113 for assembly bolts 114.

Describing the rotor 23 in greater detail, the head 51 is 0.131" high and 0.120" in diameter. The neck 53 is 0.135" high and 0.050" in diameter. The third cylindrical portion 55 is 0.062" high and has the same diameter as the head 51. The square sections of the rotor are 0.2" square. The overall height of the rotor 23 is 0.741". The rotor measures 0.731" radially. The legs 59 of the rotor extend radially 0.631" from the axis of rotation. Opposite the 45° bevel 41 is the curved portion 43 with a negative diameter of magnitude 0.250". Each leg 59 is about 0.342" long, 0.20" wide and 0.020" thick. To facilitate assembly with the guide 25, the rotor is formed from two pieces 61 and 63. The sapphire drive shaft 31 is fitted into a hole with a D-shaped cross section. A hole is provided in the rotor for the pin 69 to adjust the fit of the drive shaft 31 in the rotor.

Describing one of the three identical square center conductors in greater detail, the conductor 35 is 1.8250" long, with a 0.2" square cross section and the containing groove has a 0.5" square cross section. The resonator head 79 is 0.191" long and has a 0.109" by 0.069" cross section with chamfered corners. Two wider parallel sides are 0.110" wide, and the remaining sides are about 0.048" wide each. The shank 81 is cylindrical, 0.062" long and 0.080" in diameter. The bend near the outer end 77 includes the 45° bevel 115 and a negative circle portion 123 which is 0.250" in diameter.

The main center conductor 33 of the main transmission line 17 is essentially cylindrical with a height of 1.947" and a diameter of about 0.120". The internal dimensions of the cup 73 are a height of 0.334" and a diameter of 0.1715".

Tests on a prototype device without the shield resulted in a −16 dB coupling to unused ports and reflection of about −10 dB. With the shield 29 the results were −36 dB and −16 dB, respectively.

The guide 25 and bushing 27 fit snugly over the heads, 79, 51 of the respective square center conductors 35 and the rotor 23, preferably leaving an air gap of no more than 0.004". The spacing between the bushing 27 or guide 25 and the cup 73 or legs 59, respectively, is 0.025" or greater to ensure free relative rotation, and to enhance power handling capability. Vent holes (not shown) are added to eliminate dead air and space where there might otherwise be trapped air to allow evacuation of gaseous material in space environments.

In accordance with the above, an improved square coaxial switch for satellite communications and other applications is provided which is efficient, reliable, durable, compact and lightweight. Those skilled in the art can adapt the present invention by varying the dimensions, materials and form; e.g. different scaling can be used to accommodate other center frequencies. These and other embodiments are within the scope of the present invention.

What is claimed is:

1. A switch for coupling a main transmission line port to a selected one of a plurality of alternative transmission line ports in a square coaxial network comprising:

a housing having a central portion surrounding a central rotational axis and a plurality of alternative transmission lines extending outward from said central portion, generally orthogonal to said axis; said alternative transmission lines each having a substantially square cross-section center conductor comprising an intermediate extent and a head portion joined thereto at the radially inner end of the conductor;

a rotor assembly including a rotor having an axially directed first end and a radially directed second end mounted for rotation about said axis, the radially directed end having a pair of legs extending radially outward beyond the inner ends of the alternative transmission lines to overlap said head portions for establishing a coupling between the rotor and the head portion of a selected transmission line; and a generally disk-shaped rotor guide mounted transversely of said rotational axis and having portions extending between said head portions and said rotor legs for defining the spacing between the head portions and the rotor legs.

2. The switch of claim 1 wherein saidd guide is fabricated of a low friction, dielectric material and is mounted to fit snugly over the head portions of said center conductors for improved capacitance coupling between said head portions and the rotor legs when in overlapping juxtaposition.

3. The switch of claim 1 wherein said guide is mounted as a thrust bearing for the rotor to limit the axial movement of the rotor during rotation thereof.

4. The switch of claim 1 wherein each head portion has a pair of opposed, generally flat and parallel side faces and wherein the rotor legs, when overlapping said head portion, extend on opposite sides of the head portion for coupling thereto.

5. The switch of claim 4 wherein said head portion is generally rectangular in cross-section and includes chamfered corners

6. The switch of claim 5 further including a cylindrical shank portion of reduced diameter mounted between the head portion and the intermediate extent of the center conductor and joining the two together.

7. The switch of claim 6 further including a plurality of dielectric pegs mounted to the center conductors for supporting said conductors within the housing.

8. The switch of claim 7 wherein said dielectric pegs are mounted by pairs in mutually orthogonal directions, on pair being parallel to the axis and the other pair being perpendicular to the axis, and extending to adjacent inner surfaces of the housing.

9. The switch of claim 8 wherein the housing is formed with a plurality of pairs of grooves for receiving said dielectric pegs to maintain precise radial placement of the respective center conductors.

10. The switch of claim 9 further including a plurality of dielectric tubes encompassing portions of the dielectric pegs for reinforcing and maintaining corresponding pegs in position to support the center conductors.

11. The switch of claim 1 wherein the first end of said rotor includes a cylindrical head portion mounted coaxially along the rotational axis, said head portion being joined to a body portion of the rotor by a cylindrical neck portion of reduced diameter, relative to the diameter of the head portion.

12. The switch of claim 11 wherein the rotor assembly further includes a first bushing fitted snugly on the rotor head portion for maintaining the first end of the rotor in alignment with the axis during rotation.

13. The switch of claim 12 wherein the rotor assembly further includes a generally cylindrical shield substantially surrounding the rotor and mounted to saaid bushing, said shield having a single side opening through which the radially directed end of the rotor protrudes to overlap the head portions of the alternative transmission line center conductors.

14. The switch of claim 13 further including a shaft mounted coaxially in the rotor and extending along the housing axis to a second bushing mounted in the housing for supporting the rotor rotationally.

15. The switch of claim 1 wherein the central portion of the housing includes means for coupling said main port to said first end of said rotor, said means comprising an insulating support member extending transversely to fix the axial location of a center conductor of said main port and supporting a cup coupled to said center conductor and extending axially to surround the first end of the rotor.

16. The switch of claim 15 wherein said cup is mounted in a stationary position within said housing and wherein the rotor head portion rotates within the cup in coupling relationship therewith.

17. The switch of claim 16 further including first bushing fitted snugly on the rotor head portion for supporting the rotor head portion with substantially constant spacing from the interior wall of the cup during rotation of the rotor head portion therein.

18. The switch of claim 17 wherein said bushing is formed of a low-friction dielectric material for increased capacitance coupling between the rotor head portion and the cup.

19. The switch of claim 1 wherein the center conductors of the alternative transmission lines each have an outer end port extending generally orthogonally from said intermediate extent and adapted to connect to a corresponding transmission line element of said network.

* * * * *